United States Patent [19]

Hoshino

[11] Patent Number: 5,046,700

[45] Date of Patent: Sep. 10, 1991

[54] DRUM MOUNT FOR SECURING CLAMP

[75] Inventor: Yoshihiro Hoshino, Nagoya, Japan

[73] Assignee: Hoshino Gakki Co., Ltd., Japan

[21] Appl. No.: 353,193

[22] Filed: May 16, 1989

Related U.S. Application Data

[63] Continuation of Ser. No. 209,507, Jun. 21, 1988, abandoned.

[30] Foreign Application Priority Data

Oct. 2, 1987 [JP] Japan ..... 62-151276

[51] Int. Cl.[5] ..... G10G 5/00

[52] U.S. Cl. ..... 248/638; 248/632; 84/431

[58] Field of Search ..... 248/632, 638, 615, 674, 248/634, 231.5; 84/431

[56] References Cited

U.S. PATENT DOCUMENTS

| | | | |
|---|---|---|---|
| 1,419,293 | 6/1922 | Myers | 248/632 |
| 2,092,919 | 9/1937 | Johnson | 248/632 |
| 3,576,149 | 4/1971 | Slingerland, Jr. . | |
| 3,749,340 | 7/1973 | Williams | 248/615 |
| 3,955,465 | 5/1976 | Zickos . | |
| 4,158,980 | 6/1979 | Gauger . | |
| 4,448,105 | 5/1984 | Cordes . | |
| 4,640,175 | 2/1987 | Hoshino | 84/421 |

FOREIGN PATENT DOCUMENTS

| | | | |
|---|---|---|---|
| 3339397 | 5/1985 | Fed. Rep. of Germany | 84/421 |

*Primary Examiner*—Alvin C. Chin-Shue

*Attorney, Agent, or Firm*—Osterlenk, Faber, Gerb & Soffen

[57] ABSTRACT

A clamp is supported on the side of a drum for mounting the drum on a support rod. The clamp is mounted so as to avoid concentration of the load on a single part of the drum body. The clamp is cushioned at opposite vertical ends of the clamp where it is attached to the drum body to minimize the transmission of vibration of the drum to the support rod.

9 Claims, 2 Drawing Sheets

DRUM MOUNT FOR SECURING CLAMP

This is a continuation of application Ser. No. 209,507, filed June 21, 1988, now abandoned.

BACKGROUND OF THE INVENTION

1. Field of the Invention

The present invention relates to a clamp for supporting a drum to a holding rod, which rod in turn is connected to a stand, or the like. The clamp is fixed to the drum body by an installation part of the clamp. The invention particularly concerns a vibration absorption seat at spaced apart ends of the installation part.

2. The Prior Art

Drum holding clamps include a fixed installation part which is secured, for instance, on the side of the drum body and include a movable clamping part which is moved to clamp against the fixed part by means of a screw or other clamp tightener. The fixed installation part is usually directly fixed at an axial location approximately at the vertical center of the drum body. Such direct securement to the drum body permits vibration of the drum as it is played to easily be transmitted to the drum stand or support through the fixed installation part and the rod connecting the clamp to the stand. The attachment of the fixed part at one location on the drum body applies a concentrated load to that part of the drum body and increases the transmission of vibration to the drum support. Since the type of drum supported by such a clamp, such as a tom-tom, is usually set either in a vertical axis orientation, or in a somewhat forwardly tilted orientation, a strain or localized stress damage could develop in the part of the drum body secured to the fixed installation part. Such a strain could unfavorably affect the performance of the drum or its continued securement.

SUMMARY OF THE INVENTION

The primary object of the present invention is the solution of the aforementioned problems by providing a mount to the drum body for a clamp, which mount does not readily transmit but instead absorbs vibration of the drum.

Another object of the invention is to avoid concentration of the load of supporting the drum on one part of the drum body through the construction of the mount.

The drum holding clamp of the present invention is fixed to the drum. It includes a fixed installation part that is comprised of two vertically separated ends. Each end is attached to the drum body through a respective vibration absorbing seat at the end. Because the drum holding rod is clamped to the drum body through an installation part which has vibration absorption seats at both ends, the vibration of the drum body at the mount to the clamp is absorbed by the vibration absorption seat so that the vibration no longer is transmitted through the holding rod to the drum support or stand. Further, since the drum body is supported at both vertical ends of the fixed installation part, the load on the drum body of the installation part is also dispersed which disperses the vibration. Strain due to the concentration of the load on the drum body is avoided. It becomes possible by this means to reduce vibration transmission and strain at and of the drum body and to increase the reproducibility of the drum sound.

BRIEF DESCRIPTION OF THE DRAWINGS

The foregoing and other objects and features of the present invention will become apparent in the following description and accompanying drawings in which.

DESCRIPTION OF THE PREFERRED EMBODIMENT

Figure 1:
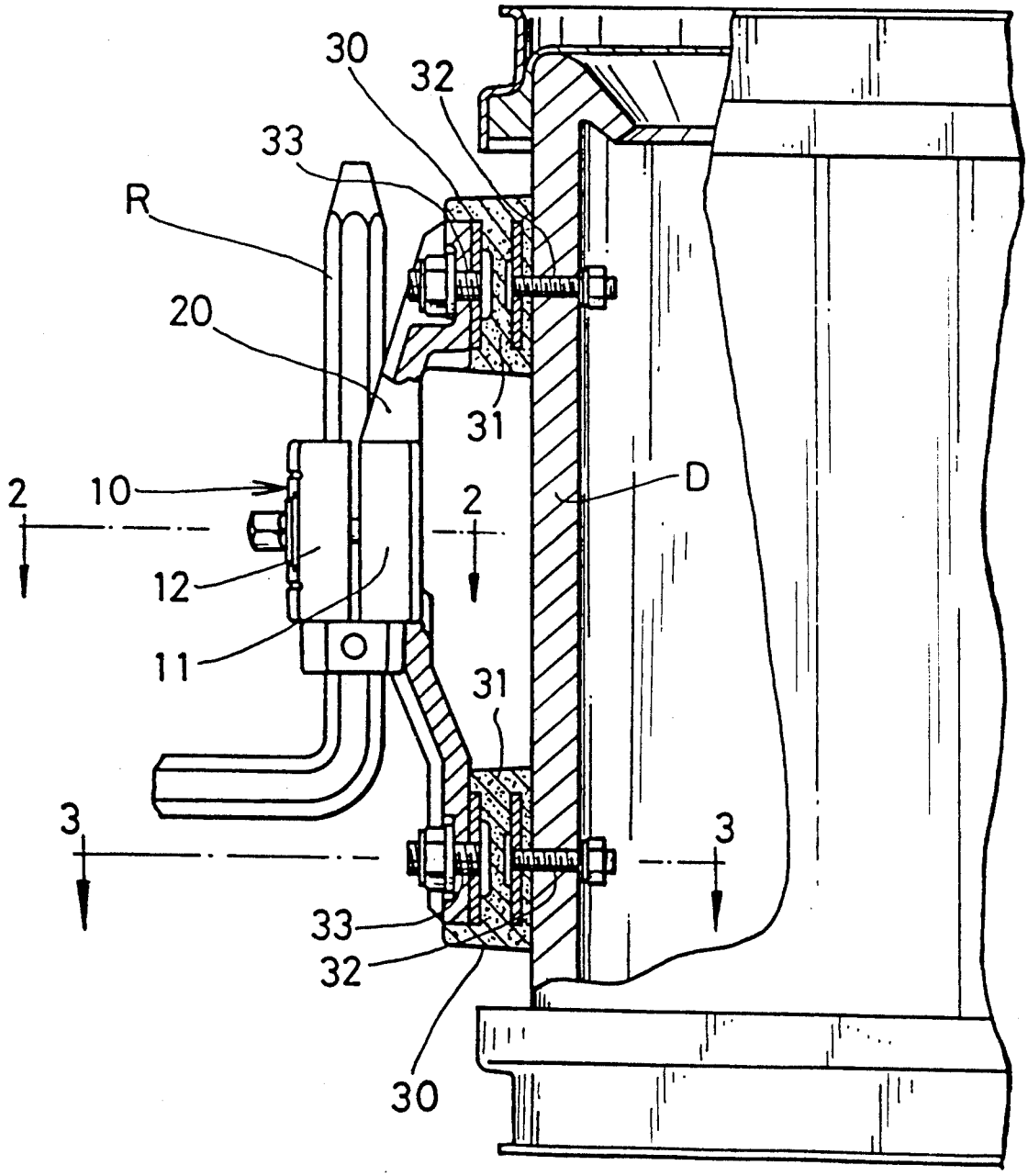
FIG. 1 is a side view, partly in section, of a drum holding clamp and mount of the present invention.
Figure 2:
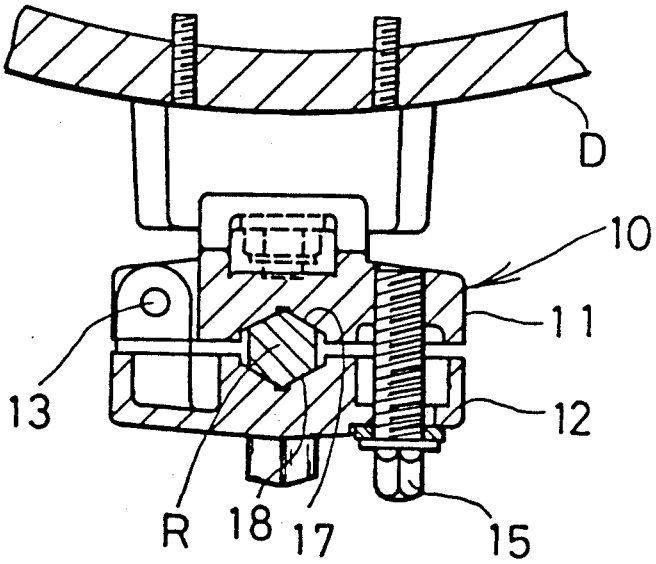
FIG. 2 is a view partly in section of the clamp mount, taken along line 2,2 of FIG. 1.

Referring to FIG. 1, the holding clamp 10 comprises a fixed installation part 11, which is mounted on the side wall of the drum body D with the mount 20, 30–35 of the invention, and further comprises a movable clamping part 12 for clamping the drum holding rod R to the fixed part 11. The fixed part includes a vertically extending installation member 20 which has a vibration absorption seat 30 at both vertical ends to damp the vibrations of the drum body D.

Various known clamping structures can be used. Here, a movable clamping part 12 is pivoted opened and closed around a vertical pivot axis 13 of the fixed part 11 on the side of the drum by means of the clamping screw 15. The drum holding rod R, which is attached to a stand or support for the drum, is inserted into the transversely extending, parallel, complementary holding grooves 17 and 18 of the members 11 and 12, respectively. The rod R is either securely clamped or loosened by adjustments of the screw 15.

The fixed installation part 11 is affixed to the drum body through an installation member 20, which is formed integrally with the fixed installation part 11. It is preferable that the installation member 20 be formed of a rigid material, such as metal. The member 20 is slightly curved in shape for defining two legs, and the member 20 is oriented so that the ends of its legs are spaced vertically apart along the drum body. Both ends or legs ends of the installation member 20 are attached through a respective vibration absorption seat 30 at a respective upper location and lower location along the drum body D.

Each vibration absorption seat 30 includes a main body 31 formed of vibration absorbing material, such as rubber, in its entirety. The seat 30 has a drum installation screw 32 that extends to the side of the drum body D and has a fixing screw 33 on the side of the installation member 20 that attaches the seat 30 to the member 20.

Figure 3:
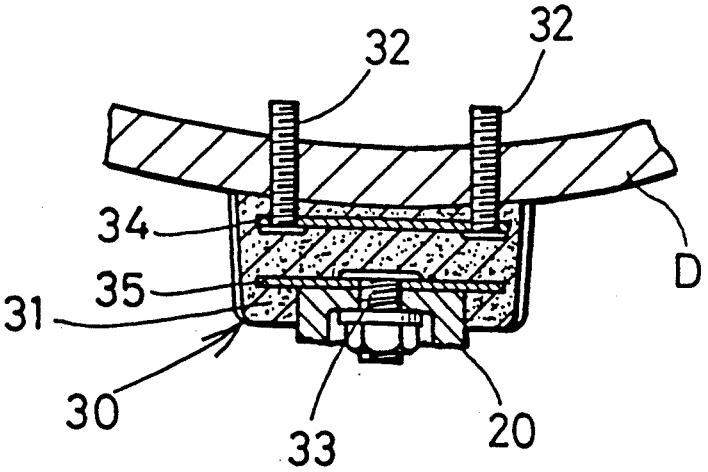
FIG. 3 is a view partly in section of the vibration absorbing seat of the clamp mount, taken along line 3,3 of FIG. 1.

Referring to FIGS. 1 and 3, there are embedded in the seat body 31 transversely extending thin strips or blades of metal, including 34 toward the drum body side D of the seating body 31 and 35 toward the installation member 20 in the body 31. The blades 34 and 35 are spaced apart so that there is vibration absorption material between them. To the blade 34 a drum installation screw 32 and to the blade 35 an installation member fixing screw 33 are secured. The drum installation screw 32 and the installation member fixing screw 33 are separated and spaced apart within the main seating body 31 which avoids vibration transmission between them.

In the foregoing, the present invention has been described in connection with an illustrative embodiment.

Since many variations and modifications of the present invention will now be obvious to those skilled in the art, it is preferred that the scope of the present invention be determined not by the specific disclosures herein contained, but only by the appended claims.

What is claimed is:

1. A mount for a clamp for mounting the clamp on the side of a drum body, the clamp being for mounting the drum body on a rod, the mount comprising:

a fixed installation part to be fixed to the side of the drum body;

a movable clamping part movable toward and away from the fixed installation part for clamping the rod;

a rigid installation member to which the fixed installation part is secured; the installation member having first and second spaced apart attachment areas, and the attachment areas being attached to the drum body at vertically spaced locations along the drum body;

a first vibration absorption seat at said first attachment area of the installation member; the first vibration absorption seat being made of resilient vibration absorbing material; first attachment means for attaching the seat on the side of the drum body with said resilient vibration absorbing material contacting the side of the drum body; and separated second attachment means for attaching the seat of the installation member;

a second vibration absorption seat at said second attachment area of the installation member; the second vibration absorption seat being made of resilient vibration absorbing material, said resilient vibration absorbing material of said second seat being separated and vertically spaced apart from said resilient vibration absorbing material of said first seat; third attachment means for attaching the second seat on the side of the drum body with said resilient vibration absorbing material of said second seat contacting the side of the drum body; and separated fourth attachment means for attaching the second seat to the installation member;

wherein each seat is for reducing the transmission of vibrations to the rod and where both seats avoid concentration of the load on any part of the drum body.

2. The clamp mount of claim 1, wherein the rigid installation member has one leg extending toward one end of the drum body, and the one leg having the first attachment area thereon, the installation member having a second leg extending toward the opposite end of the drum body, the second leg having the second attachment area thereon.

3. The clamp mount of claim 2, wherein each leg has an end at which the respective attachment area is disposed.

4. The clamp mount of claim 1, further comprising the first attachment means being at one side of the first vibration absorption seat and the second attachment means being at the opposite side of the first vibration absorption seat.

5. The clamp mount of claim 4, wherein the first attachment means comprises a first plate embedded in the first seat and a first attachment element between the first plate and the drum body for pulling said first plate toward said drum body to compress said resilient vibration absorbing material of said first seat between said first plate and the drum body, the second attachment means comprises a second plate embedded in the first seat and spaced from the first plate and a second attaching element between the second plate and the installation member.

6. The clamp mount of claim 5, wherein each of the ends of the drum is free of intrusion by said clamp.

7. The clamp mount of claim 2, wherein the first attachment means comprises a first plate embedded in the first seat and a first attaching element between the first plate and the drum body, the second attachment means comprises a second plate embedded in the first seat and spaced from the first plate and a second attaching element between the second plate and the installation member.

8. The clamp mount of claim 1, wherein said first attachment means is embedded within said vibration absorbing material of said first seat, the first attachment means extending beyond said vibration absorbing material of said first seat so as to extend through the side of the drum body when said vibration absorbing material of said second seat contacts the side of the drum body;

said third attachment means being embedded within said vibration absorbing material of said second seat, said third attachment means extending beyond said vibration absorbing material of said second seat so as to extend through the side of the drum body when said vibration absorbing material of said second seat contacts the side of the drum body.

9. The clamp mount of claim 8, wherein said attachment means include screws.

* * * * *